US005844465A

United States Patent [19]

Armenio et al.

[11] Patent Number: 5,844,465

[45] Date of Patent: Dec. 1, 1998

[54] TEMPERATURE COMPENSATED TIME-DELAY SWITCH

[75] Inventors: Eduardo Armenio, Aversa; Giancarlo Attena, Naples; Giuseppe Notaro, Pomogliano D'Arco, all of Italy

[73] Assignee: Texas Instruments Incorporated, Dallas, Tex.

[21] Appl. No.: 743,436

[22] Filed: Nov. 1, 1996

[30] Foreign Application Priority Data

Nov. 18, 1996 [IT] Italy ..... RM.95-A/000830

[51] Int. Cl.[6] ..... H01H 37/04; H01H 37/14

[52] U.S. Cl. ..... 337/377; 337/13; 337/102; 337/140; 337/333; 337/342; 337/380

[58] Field of Search ..... 337/1, 3, 13, 14–16, 337/20, 52, 53, 77, 99–102, 107, 139–141, 333, 342, 362, 365, 367, 368, 377–380; 361/103, 105, 106; 219/505, 552; 392/502

[56] References Cited

U.S. PATENT DOCUMENTS

| | | | |
|---|---|---|---|
| 3,205,327 | 9/1965 | Moorhead et al. | 200/122 |
| 3,434,089 | 3/1969 | Waseleski, Jr. et al. | 337/40 |
| 3,463,008 | 8/1969 | Teichert et al. | 337/300 |
| 3,474,372 | 10/1969 | Davenport et al. | 337/1 |
| 4,356,704 | 11/1982 | Izumi | 62/158 |
| 4,633,210 | 12/1986 | Mallonen et al. | 337/101 |
| 4,845,455 | 7/1989 | Saka et al. | 337/49 |
| 4,862,132 | 8/1989 | Holweck | 337/102 |

*Primary Examiner*—Leo P. Picard
*Assistant Examiner*—Jayprakash N. Gandhi
*Attorney, Agent, or Firm*—Russell E. Baumann; Richard L. Donaldson; Rene' E. Grossman

[57] ABSTRACT

A time-delay switch responsive to a sensor 36 having a temperature compensation feature including bimetallic creep-type strip elements (10, 11). Additionally, the switch has an alarm function (A) with a manual reset button (9).

11 Claims, 2 Drawing Sheets

TEMPERATURE COMPENSATED TIME-DELAY SWITCH

FIELD OF THE INVENTION

The present invention relates to a device which includes a time-delay electrical switch system with electrical circuit associated with a sensor, particularly suitable for being used as a protection element for an apparatus such as a refrigeration compressor which may be damaged if run in an unlubricated over temperature condition.

BACKGROUND OF THE INVENTION

It has been known in the prior art to use a pressure sensor based electrical switch for use with a motor compressor to indicate the presence of oil for lubrication in a refrigeration compressor and to stop the operation of it when none in present. Such a sensor apparatus system has typically incorporated a time-delay feature which would delay the shut down of the compressor for specific small periods of time to provide for start-up conditions and standard short intermittent loss of lubrication conditions.

Such electrical switch systems have proven useful, but it would be desirable to provide an improved system that can better take into account the many operational conditions the compressor can become subjected to in use.

SUMMARY OF THE INVENTION

Accordingly, it is an object of the present invention to provide an improved sensor based electrical switch system with time delay and temperature compensation features.

It is another object of the present invention that such an improved switch system further includes a heat accumulation means to better reflect the cumulative effect of multiple short term lubrication losses.

It is another object of the present invention to provide such a switch system which is a "one shot" system with an alarm function and requirement for manual reset.

It is yet still another feature of the present invention to provide a switch system allowing for multiple voltage applicability.

Briefly, an electrical switch of the present invention for controlling the supply of power to a load as a function of a physical characteristic to be measured comprises a housing, an electrical circuit mounted in said housing including a relay and a sensor for measuring physical characteristics electrically connected between the supply of power and the load, a first bimetallic strip element mounted in said housing with one end fixed and the other end free to move in response to temperature change, thermally coupled to a heat accumulator element; a Positive Temperature Coefficient (PTC) heater element adapted to be connected in said electrical circuit for applying heat to said heat accumulator element upon becoming energized in said electrical circuit; a second bimetallic strip mounted in said housing with one end fixed and the other end free to move in response to temperature change, arranged adjacent to the first bimetallic strip element and apart from said heat accumulator element to be subject primarily to only the environmental temperature; connector means for providing for mechanically linking of movement between said first and second bimetallic strip elements; a transfer mechanism positioned to be movable upon movement of said first bimetallic strip element and switching means including a bistable spring element for connecting and disconnecting said supply of power to said load actuatable upon a force applied by movement of said transfer member.

DESCRIPTION OF THE DRAWINGS

Other objects, advantages and details of the switch system of this invention appear in the following detailed description of the preferred embodiments of the invention and the detailed description referring to the drawings in which.

DETAILED DESCRIPTION OF THE PREFERRED EMBODIMENTS

Figure 1:
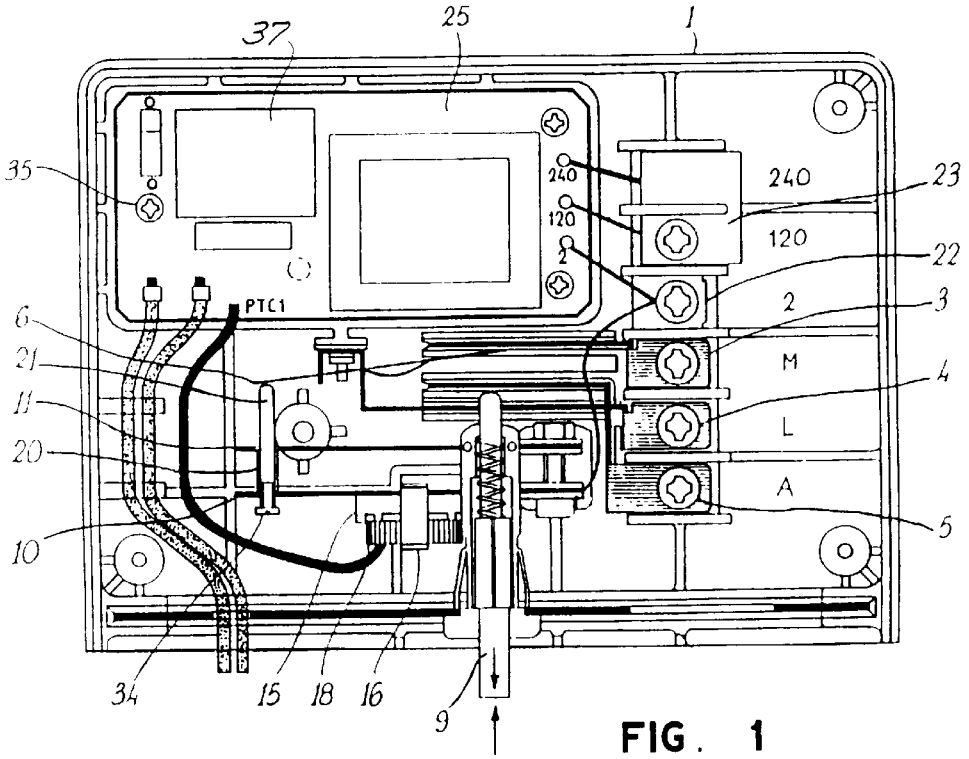
FIG. 1 is a diagrammatic view of a device of the present invention without its cover.

With reference to the drawings (FIGS. 1 and 4), the electrical switching system of the present invention includes a housing 1 which is typically closed with a cover (not shown) made of an electrically insulating material such as plastic or the like with a plurality of electrical terminals 3, 4, 5, 22 and 23 for connections with external circuits 240, 120, 2, M, L and A. Housing 1 contains an electrical circuit 25 having among the circuit components a relay 37, a transformer T, a bridge B and terminals indicated by S1, S2, PTC1, 240, 120 and 2. Housing 1 also contains a first bimetallic creep-type strip element 10, fixed at one end with the other end being free to move, directly adjacent and preferably connected to a heat accumulator element 15 which in turn is thermally coupled to a Positive Temperature Coefficient (PTC) heater element 18. Heat accumulator element 15 is typically made of a metal of preselected size, shape and thermal conductivity to yield a preselected known thermal mass. PTC heating element 18 is connected to electrical circuit 25 by relay 37 through terminals PTC1 and 2.

In accordance with this invention, housing 1 also contains a second bimetallic creep-type strip element 11, fixed at one end with the other end being free to move. Second strip element 11 is preferably positioned to be generally parallel to first strip element 10 but apart from PTC heater element 18 and heat accumulator element 15. The free end of strip 11 has an aperture therein through which a transfer pin 21 can pass as will be further explained below. A hollow spacer element 20 of a preselected height (C—D) is positioned between strip elements 10 and 11 typically being attached to both strip elements at the free end of the strips with a central bore of such a size to freely receive transfer pin 21. This spacer element selects the minimum distance between the strips and generally provides for the strips to move up and down together.

As mentioned above, a transfer pin 21 is also contained within housing 1 extending through and being positioned in spacer element to move freely up and down in response to the movement of strip member 10. Generally, pin 21 extends through spacer element 20 and the aperture in second strip member 11 to a distal end portion. This distal end portion is positioned to be able to engage and activate a bistable spring element 6. Bistable spring element 6 typically made of metal is positioned in housing 1 so that in a first position its free end makes contact with terminal 3 and upon snapping to a second position, it makes contact with terminal 5. Element 6 is activated to snap from its first position to its second position due to a force being applied by the movement of transfer pin 21 against it. The relative positioning between transfer pin 21 and element 6 can be adjusted or calibrated by a regulating screw 34 positioned to engage the end opposite the distal end portion of the pin that contacts spring element 6 as clearly shown in FIG. 4.

The electrical switching system of the present invention includes a reset button 9 for manually resetting bistable spring element 6 back to its original first position (engagement with terminal 3) after snapping to its second position (engagement with terminal 5).

Figure 2:
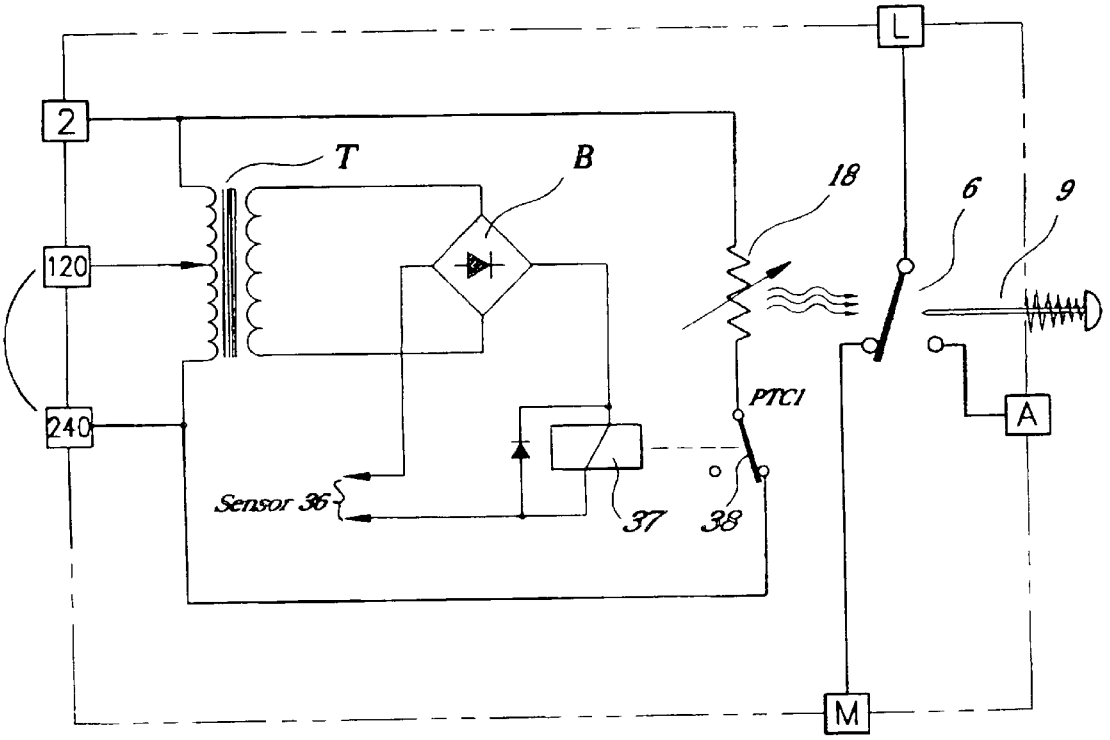
FIG. 2 is a diagram of the electrical circuit which is a part of the device of FIG. 1.

With the structure of the switch system, as disclosed above and referring to the circuit diagram of FIG. 2, the operation of switching system of the present invention will be disclosed below.

The sensor 36 detects whether the physical characteristic to be measured (pressure, etc.) is within the range of normal operation; whenever it is, terminals S1 and S2 are closed and the relay 37 is powered and holds the switch 38 open.

In this way, with the switch 38 open, there is no supply of power to the PTC element 18 and the switch 6 furnishes the normal supply of power to the user electrical device or load M. When the sensor 36 detects that the physical characteristic to be measured is outside of the range of normal operation, the terminals S1 and S2 are opened and the relay 37 loses its supply of power. In this condition, the switch 38 moves to a closed position and power is supplied to the PTC heating element 18 which generates heat. The heat generated by PTC heating element 18 acting through heat accumulator element 15 after a selected predetermined time activates bistable switching element 6 controlled by the movement of first bimetallic strip 10 acting through the transfer member 21.

The bistable element 6 in this way switches the power from the user device (M) connected to the line (M) through the terminals 4, 3 to an open circuit condition or an alarm circuit (A) (see FIG. 2) connected to the terminals 4, 5.

Figure 4:
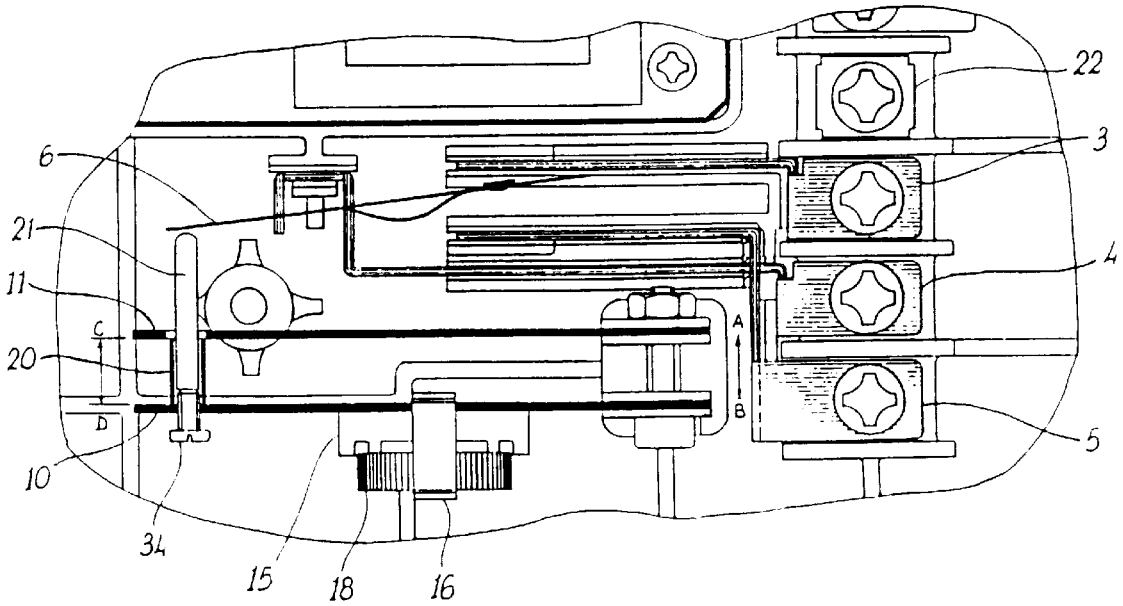
FIG. 4 shows in enlarged detail a section of the device of FIG. 1.

Reference is now made to FIG. 4 which shows an enlarged view of the switching portion of FIG. 1.

When the physical characteristic to be measured is outside of the range of operation, the PTC terminals 1 and 2 power the PTC heating element 18 which generates the heat accumulated in a special element 16 which includes heat accumulator 15. From there, the heat is transmitted to the bimetallic strip 10 which as a result of the thermal expansion will tend to curve at its end and then to press transfer pin 21 longitudinally (upward) to activate the bistable element 6. This action overcomes the opposing action of the second bimetallic strip 11 which exerts a pressure on the first bimetallic strip 10 generally proportional to the value of the environmental temperature. It should be noted that it is often desirable that the two bimetallic strips are arranged with their respective surfaces opposite each other and positioned so that the distance A—B between their fixed ends is less than the distance C—D between their free ends. This difference of distances provides for a pre-load force which is exerted on the activating bimetallic strip 10 by the bimetallic strip 11. Such a preload force can be varied as desired.

The bimetallic strip 11 will perform the function as a temperature element compensator because the aforesaid preload exerted by strip 11 on the first bimetallic strip 10 will decrease as the temperature decreases and will increase as the latter increases. In fact, thanks to the fact that the corresponding surfaces of the two bimetallic strips are placed adjacent to each other, when the environmental temperature drops, the two strips will tend to move away from each other, reducing the preload, while when the environmental temperature rises, the latter will tend to approach each other, increasing the initial preload.

With a structure made in this manner, increasing the initial preload, that is, the difference of the ratio A–B and C–B, the ambient temperature range may be increased or decreased so that the trip time of the device remains constant and is not affected by ambient temperature changes.

As transfer member 21 is pushed axially upward, bistable element 6 passes from the position in which it is in contact with terminal 3 to the position in which it is in contact with terminal 5. Thus, the power is removed from the electric motor M or any other type of load which one wishes to protect and an alarm lamp A is powered. The bistable spring element 6 can be brought back to its initial position by manual reset button 9 again connecting terminal 3 to the power supply circuit.

In accordance with the present invention, additional characteristics of the present invention will be described and specified below.

In the present form of implementation of the invention, there is moreover provided a calibration means so as to be able to vary the delay time by adjusting regulating screw 34 which permits varying the position of transfer pin 21 relative to bistable blade 6.

Additionally, the time delay of the switching system can be varied by changing the heating quantity of PTC heating element 18 and the thermal mass of accumulator 16 which determines the amount of heat transmitted per unit of time to bimetal strip 10.

For the most suitable applications in which the present invention may be used, the activation delay time is of the order of minutes.

In the present form of implementation of the invention, there is also anticipated the introduction of means to allow for the use of a power supply of either 120 volts or 240 volts. Such means, as are known in the art, involve the use of a transformer as is shown in FIGS. 2 and 3.

Figure 3:
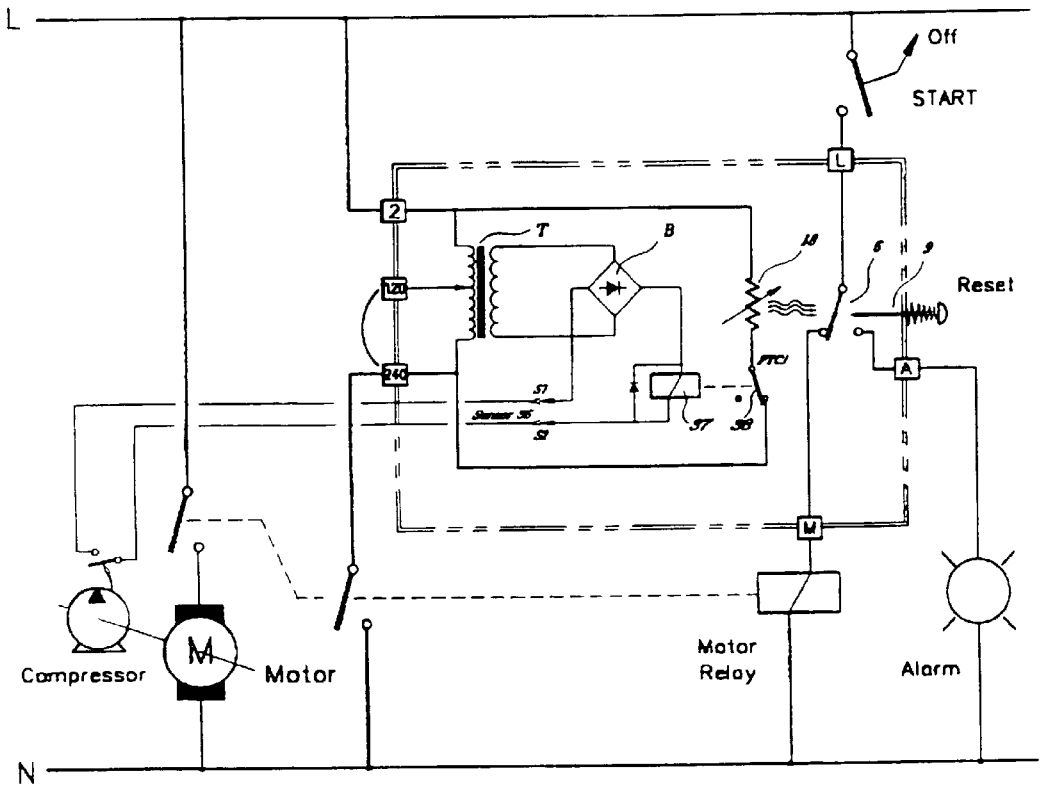
FIG. 3 is a diagram of the electrical circuit of FIG. 2 as part of a control circuit for a compressor and motor.

FIG. 3 better shows how the electric circuit is connected to the other parts of the switching system. In particular, there is a representation of electric motor M and alarm circuit A.

As various changes and modifications could be made in the above embodiments without departing from the essence of the invention, it is intended that any such changes or modifications are deemed to be within the scope of the invention as set forth in the appended claims.

We claim:

1. An actuator device for controlling the supply of power to a load as a function of a physical characteristic to be measured comprising: a housing; an electrical circuit mounted in said housing including a relay and a sensor for measuring said physical characteristic electrically connected between the supply of power and the load; a first bimetallic strip element mounted in said housing with one end fixed and the other end free to move in response to temperature change, thermally coupled to a heat accumulator element; a Positive Temperature Coefficient (PTC) heater element adapted to be connected in said electrical circuit to apply heat to said heat accumulator element upon being energized in said electrical circuit; a second bimetallic strip mounted in said housing with one end fixed and the other end free to move in response to temperature change; arranged adjacent to the first bimetallic strip element; and apart from said heat accumulator element to be subject primarily to only the environmental temperature, connector means for providing for mechanically linking of movement between said first and second bimetallic strip elements, a transfer mechanism positioned to be movable upon movement of said first bimetallic strip element and switching means for connecting and disconnecting said supply of power to said load actuatable upon a force applied by said transfer member.

2. An actuator according to claim 1 wherein said switching means includes a bistable spring element resetable by manual operation.

3. An actuator according to claim 1 wherein said bimetallic strip members have their surfaces opposed to each other and are mounted in such a way so that the distance between their fixed ends is less than the distance between their free ends.

4. An actuator according to claim 1 wherein said sensor measures one of pressure and temperature in the load for indicating the presence of a fluid for lubrication.

5. An actuator according to claim 1 further including a calibration means for properly positioning said transfer mechanism relative to said switching means.

6. An actuator according to claim 5 wherein said calibration means is a screw member.

7. An actuator according to claim 2 further including a manual reset button.

8. An actuator according to claim 1 further including an alarm circuit which is actuated upon the disconnecting of said supply of power to said load.

9. An actuator according to claim 1 wherein the heat accumulator element has a preseleted known thermal mass.

10. An actuator according to claim 9 wherein said heat accumulator element is a metal element.

11. An actuator according to claim 1 wherein it can be used for 120 or 240 volt applications.

* * * * *